US009562421B2

(12) United States Patent
Hardesty et al.

(10) Patent No.: US 9,562,421 B2
(45) Date of Patent: Feb. 7, 2017

(54) LIMITED ENTRY PHASED PERFORATING GUN SYSTEM AND METHOD

(71) Applicant: GEODynamics, Inc., Millsap, TX (US)

(72) Inventors: John T. Hardesty, Weatherford, TX (US); Nathan G. Clark, Mansfield, TX (US); James A. Rollins, Lipan, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 14/598,868

(22) Filed: Jan. 16, 2015

(65) Prior Publication Data

US 2015/0226043 A1 Aug. 13, 2015

Related U.S. Application Data

(63) Continuation-in-part of application No. 14/176,056, filed on Feb. 8, 2014, now Pat. No. 9,038,521.

(51) Int. Cl.

| | |
|---|---|
| ***B64D 1/04*** | (2006.01) |
| ***E21B 43/117*** | (2006.01) |
| ***E21B 43/119*** | (2006.01) |

(52) U.S. Cl.

CPC ..... *E21B 43/117* (2013.01); *E21B 43/119* (2013.01)

(58) Field of Classification Search

USPC ... 89/1.151, 1.15; 175/4.6; 166/55, 55.1, 63, 166/171, 297

See application file for complete search history.

(56) References Cited

U.S. PATENT DOCUMENTS

| | | | |
|---|---|---|---|
| 3,062,294 | A | 11/1962 | Huitt |
| 3,089,416 | A | 5/1963 | Gilbert |
| 3,107,611 | A | 10/1963 | Caldwell |

(Continued)

FOREIGN PATENT DOCUMENTS

| | | | |
|---|---|---|---|
| EP | 2341212 | A1 | 7/2011 |
| WO | 2014179689 | A1 | 11/2014 |

OTHER PUBLICATIONS

Bersas, Stenhaug, Doornbosch, Langseth, Fimreite, Parrott, "Perforations on Target," Oilfield Review, Spring 2004, pp. 28-37, V. 16 No. 1, Schlumberger, Houston, Texas.

(Continued)

*Primary Examiner* — J. Woodrow Eldred

(74) *Attorney, Agent, or Firm* — David W. Carstens; Sudhakar V. Allada; Carstens & Cahoon, LLP

(57) ABSTRACT

A limited entry perforating phased gun system and method for accurate perforation in a deviated/horizontal wellbore is disclosed. The system/method includes a gun string assembly (GSA) deployed in a wellbore with shaped charge clusters. The charges are spaced and angled such that, when perforated, they intersect at a preferred fracturing plane. Upon fracturing, the fractures initiate at least principal stress location in a preferred fracturing plane perpendicular to the wellbore from an upward and downward location of the wellbore. Thereafter, the fractures connect radially about the wellbore in the preferred fracturing plane. The fracture treatment in the preferred fracturing plane creates minimal tortuosity paths for longer extension of fractures that enables efficient oil and gas flow rates during production.

7 Claims, 10 Drawing Sheets

(56) References Cited

U.S. PATENT DOCUMENTS

| | | | | |
|---|---|---|---|---|
| 3,241,488 | A | 3/1966 | Glass | |
| 4,753,301 | A | 6/1988 | Berry | |
| 4,756,371 | A | 7/1988 | Brieger | |
| 4,830,120 | A | 5/1989 | Stout | |
| 5,033,553 | A | 7/1991 | Miszewski | |
| 5,590,723 | A | 1/1997 | Walker et al. | |
| 6,748,843 | B1 | 6/2004 | Barker | |
| 7,303,017 | B2 * | 12/2007 | Barker et al. | 166/297 |
| 7,409,992 | B2 | 8/2008 | Zazovsky et al. | |
| 7,441,601 | B2 | 10/2008 | George et al. | |
| 7,735,578 | B2 | 6/2010 | Loehr et al. | |
| 7,913,758 | B2 * | 3/2011 | Wheller et al. | 166/259 |
| 8,127,848 | B2 * | 3/2012 | Myers et al. | 166/297 |
| 8,327,746 | B2 * | 12/2012 | Behrmann et al. | 89/1.15 |
| 8,919,443 | B2 | 12/2014 | Parker et al. | |
| 9,038,521 | B1 | 5/2015 | Rollins et al. | |
| 9,145,763 | B1 | 9/2015 | Sites, Jr. | |
| 2005/0109501 | A1 | 5/2005 | Ludwig | |
| 2005/0194146 | A1 | 9/2005 | Barker et al. | |
| 2005/0247447 | A1 | 11/2005 | Spring | |
| 2007/0158109 | A1 | 7/2007 | Zazovsky | |
| 2011/0219978 | A1 * | 9/2011 | Glenn | F42B 1/028 102/307 |
| 2013/0032347 | A1 | 2/2013 | Parker | |
| 2013/0206385 | A1 | 8/2013 | Feng et al. | |
| 2014/0041515 | A1 | 2/2014 | Mauldin | |
| 2015/0267516 | A1 | 9/2015 | Hardesty et al. | |

OTHER PUBLICATIONS

Bruyere, Clark, Stirton, Kusumadjaja, et al., "New Practices to Enhance Perforating Results," Oilfield Review, Autumn 2006, pp. 18-35, V. 18 No. 3, Schlumberger, Houston, Texas.

Scott, Carvajal, Manning, Hendry, et al., "A New Multi-Jet Gun Improves Well Production, Society of Petr Engineers," Deepwater Drilling and Completions Conf, Oct. 2010, Texas.

Triple-Jet™, "Perforating System," Halliburton, Jul. 2007, U.S.A.

ISA/US, International Search Report and Written Opinion for PCT/US2016/013579 mailed Mar. 31, 2016.

European Patent Office, European Search Report for EP16172914, dated Oct. 25, 2016.

* cited by examiner

LIMITED ENTRY PHASED PERFORATING GUN SYSTEM AND METHOD

CROSS REFERENCE TO RELATED APPLICATIONS

This application is a continuation in part application of non-provisional patent application Ser. No. 14/176,056, entitled APPARATUS FOR CREATING AND CUSTOMISING INTERSECTING JETS WITH OILFIELD SHAPED CHARGES, filed Feb. 8, 2014.

U.S. UTILITY PATENT APPLICATION

This application claims benefit under 35 U.S.C. §120 and incorporates by reference United States Utility Patent Application for APPARATUS FOR CREATING AND CUSTOMISING INTERSECTING JETS WITH OILFIELD SHAPED CHARGES by inventors James A Rollins, Nathan Clark, and Kevin George, filed electronically with the USPTO on Feb. 8, 2014, with Ser. No. 14/176,056.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

PRIOR ART AND BACKGROUND OF THE INVENTION

Field of the Invention

The present invention relates generally to perforation guns that are used in the oil and gas industry to explosively perforate well casing and underground hydrocarbon bearing formations, and more particularly to an improved apparatus for explosively perforating a well casing and its surrounding underground hydrocarbon bearing formation in a preferred fracturing plane.

Prior Art Background

During a well completion process, a gun string assembly is positioned, in an isolated, zone in the wellbore casing. The gun string assembly comprises a plurality of perforating guns coupled, to each other either through tandems or subs. The perforating gun is then fired, creating holes through the casing and the cement and into the targeted rock. These perforating holes connect the rock holding the oil and gas and the well bore. "During the completion of an oil and/or gas well, it is common to perforate the hydrocarbon containing formation with explosive charges to allow inflow of hydrocarbons to the well bore. These charges are loaded in a perforation gun and are typically shaped charges that produce an explosive formed penetrating jet in a chosen direction" U.S. Pat. No. 7,441,601.

The employment of angled shape charge placement to provide intersecting perforations has generated great interest in recent years. See for example, Triple-Jet™ Perforating System, a paper by Halliburton, Bersas, et al, Perforation on Target, Oilfield Review, and New practices to Enhance Perforating Results, Oilfield Review, (all included in the information Disclosure material of this application). The intersecting perforation assist in cleaning the debris from the perforated channel and are especially useful where there is crushed or loose material adjacent the well bore where the perforation is to be made and in sand formations.

Hydrocarbon fracturing tunnels have certain preferred orientations where the effectiveness of extracting oil/gas is greatest i.e., when a perforation is aligned along the tunnels, oil/gas flows though the perforation tunnels without taking an alternate path that may become a restrictive path creating high, tortuosity conditions.

Fractures will initiate and propagate in the preferred fracture plane of the formation. Oriented perforating systems can be used to more closely align a plane of perforation tunnels with a preferred fracture plane. Misalignment between the preferred fracture plane and perforations in a well can result in significant pressure drop due to tortuosity in the flow path near the wellbore. The perforations that are phased at 90 degrees to the preferred fracture plane create pinch points resulting in pressure loss and high tortuosity in the flow path.

Limited entry fracturing is based on the premise that every perforation will be in communication with a hydraulic fracture and will be contributing fluid during the treatment at the pre-determined rate. Therefore, if any perforation does not participate, then the incremental rate per perforation of every other perforation is increased, resulting in higher perforation friction. Therefore, there is a need, to angle and space spaced charges to facilitate the limited entry fracturing process to achieve maximum production efficiency.

By design, each perforation in limited entry is expected to be involved in the treatment. If all perforations are involved, and the perforations are shot with 60°, 90°, or 120° phasing, multiple fracture planes may be created, leading to substantial near wellbore friction and difficulty in placing the planned fracturing treatment. Therefore, there is a need for minimal multiple fracture initiations that do not create ineffective fracture planes. Currently, 4 to 8 perforation holes are shot which will reconnect to the predominant fracturing plane during fracturing treatment. Some of the perforation tunnels cause energy and pressure loss during fracturing treatment which reduces the intended pressure in the fracture tunnels. For example, if a 100 bpm fracture fluid is pumped into each fracture zone at 10000 PSI with an intention to fracture each perforation tunnel at 2-3 bpm, most of the energy is lost in ineffective fractures that have higher tortuosity reducing the injection rate per fracture to substantially less than 2-3 bpm. Consequently, the extent of fracture length is significantly reduced resulting in less oil and gas flow during production. Therefore, there is a need for a system to achieve the highest and optimal injection rate per perforation tunnel so that a maximum fracture length is realized. The more energy put through each perforation tunnel, the more fluid travels through the preferred fracturing plane, the further the fracture extends. Ideally, 1000 of feet of fracture length from the wellbore is desired. Therefore, there is a need to get longer extension of fractures which have minimal tortuosity. For example, in order to achieve 2 bpm in each perforation tunnel, a total injection rate of 100 bpm at 1000 psi for 50 perforation tunnels requires 12 clusters each with 4 charges. Therefore, there is a need to shoot more zones with 4 perforating holes in each cluster that are oriented 2 up and 2 down. There is also a need for a swivel/gimbal system to orient the charges in the desired direction to interest at the preferred fracturing plane.

There is a need for the fracture to initiate at the top and bottom first that has the least principal stress so that there is enough flow rates to propagate the fracture. There is a need for a perforating gun that perforates such that the fracture permeates radially to the direction of the wellbore.

Prior art U.S. Pat. No. 8,327,746 discloses a wellbore perforating devices. In one example, a wellbore perforating device includes a plurality of shaped charges and a holder that holds the plurality of shaped charges so that upon detonation the charges intersect a common plane extending transversely to the holder. However, there is a need to fracture intersecting jets into a preferred fracturing plane so that a fracture initiates and propagates transversely into a hydrocarbon formation.

Prior art U.S. Pat. No. 8,127,848A discloses a method of perforating a wellbore by forming a perforation that is aligned with a reservoir characteristic, such as direction of maximum stress, lines of constant formation properties, and the formation dip. The wellbore can be perforated using a perforating system employing a shaped, charge, a mechanical device, or a high pressure fluid. The perforating system can be aligned, by asymmetric weights, a motor, or manipulation from the wellbore surface. However, there is a need for fracturing upwardly and downwardly to create preferred fracture initiation point at select lengths in the preferred fracturing plane.

Prior art U.S. Pat. No. 7,913,758A discloses a method for completing an oil and gas well completion is provided. The perforators (10, 11) may be selected from any known or commonly used perforators and are typically deployed in a perforation gun. The perforators are aligned such that the cutting jets (12, 13) and their associated Shockwaves converge towards each other such that their interaction causes increased fracturing of the rock strata. The cutting jets may be also be aligned such that the cutting jets are deliberately caused to collide causing further fracturing of the rock strata. In an alternative embodiment of the invention there is provided a shaped charge liner with at least two concave regions, whose geometry is selected such that upon the forced collapse of the liner a plurality of cutting jets is formed which jets are convergent or are capable of colliding in the rock strata. However, there is a need, to fracture into a preferred fracture initiation point in a preferred fracture plane.

Prior art U.S. Pat. No. 7,303,017A discloses a perforating gun assembly (60) for creating communication paths for fluid between a formation (64) and a cased wellbore (66) includes a housing (84), a detonator (86) positioned within the housing (84) and a detonating cord (90) operably associated with the detonator (86). The perforating gun assembly (60) also includes one or more substantially axially oriented collections (92, 94, 96, 98) of shaped charges. Each of the shaped charges in the collections (92, 94, 96, 98) is operably associated with the detonating cord (90). In addition, adjacent shaped charges in each collection (92, 94, 96, 98) of shaped charges are oriented to converge toward one another such that upon detonation, the shaped, charges in each collection (92, 94, 96, 98) form jets that interact with one another to create perforation cavities in the formation (64). However, there is a need for fracturing upwardly and downwardly into a preferred fracturing plane perpendicular (transverse) to the well bore orientation.

DEFICIENCIES IN THE PRIOR ART

The prior art as detailed above suffers from the following deficiencies:

- Prior art systems do not provide for minimizing multiple fracture initiations within a fracture stage.
- Prior art systems do not provide for 2 or 4 orienting shaped charges in a cluster that intersect at a preferred fracturing plane when perforated,
- Prior art systems do not provide for orienting shaped charges with an internal swivel.
- Prior art systems do not provide for efficiently reducing tortuosity and energy loss in a perforation tunnel.
- Prior art systems do not provide for radially extended longer fractures in a preferred perforation plane.
- Prior art systems do not provide for perforating more zones with less number of perforations in each cluster for increasing wellbore production efficiency.
- Prior art systems do not provide a system to fracture into a preferred fracture initiation point in a preferred fracture plane.

While some of the prior art may teach some solutions to several of these problems, the core issue of reacting to unsafe gun pressure has not been addressed by prior art.

OBJECTIVES OF THE INVENTION

Accordingly, the objectives of the present invention are (among others) to circumvent the deficiencies in the prior art and affect the following objectives:

- Provide for minimizing multiple fracture initiations within a fracture stage.
- Provide for 2 or 4 orienting shaped charges in a cluster that intersect at a preferred fracturing plane when perforated.
- Provide for orienting shaped charges with an internal swivel attached to the perforating gun.
- Provide for efficiently reducing tortuosity, energy loss and pressure loss in a perforation tunnel.
- Provide for radially extended longer fractures in a preferred perforation plane.
- Provide for perforating more zones with less number of perforations in each cluster for increasing wellbore production efficiency.
- Provide for a system to fracture into a preferred fracture initiation point in a preferred fracture plane.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention in various embodiments addresses one or more of the above objectives in the following manner. The present invention provides a system that includes a gun string assembly (GSA) deployed in a wellbore with shaped, charge clusters. The charges are spaced and angled such that, when perforated, they intersect at a preferred fracturing plane. Upon fracturing, the fractures initiate at least principal stress location in a preferred fracturing plane perpendicular to the wellbore from an upward and downward location of the wellbore. Thereafter, the fractures connect radially about the wellbore in the preferred fracturing plane. The fracture treatment in the preferred fracturing plane creates minimal tortuosity paths for longer extension of fractures that enables efficient oil and gas flow rates during production.

Method Overview

The present invention system may be utilized in the context of an overall limited entry phasing perforating method, wherein the phasing perforating gun system as described previously is controlled by a method having the following steps:

(1) positioning the gun along with the plural upward charges and plural downward charges in the wellbore casing;

(2) orienting plural upward charges and plural downward charges in a desired direction; and (3) perforating with plural upward charges and plural downward charges into a hydrocarbon formation such that plural upward charges and plural downward charges intersect at the preferred fracturing plane.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
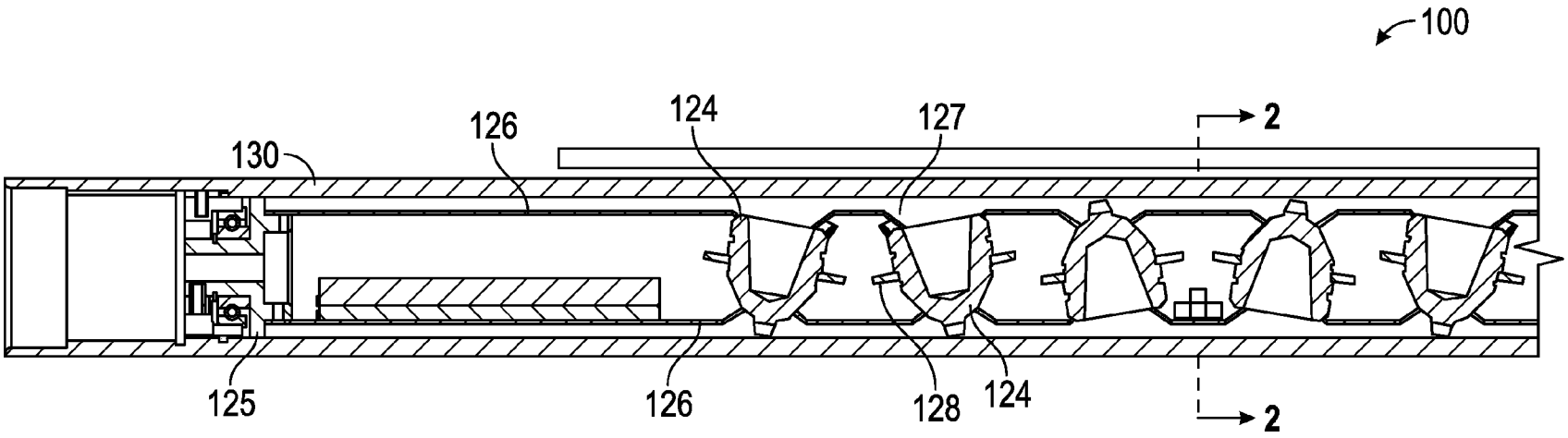
FIG. 1 is a sectional view of an embodiment of a perforation gun assembly of the invention.

While this invention is susceptible of embodiment in many different forms, there is shown, in the drawings and will herein, be described in detailed, preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a limited entry phasing perforating gun system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

This invention provides an improved tool (gun) and method of installing shaped charges at variable angles within a carrier assembly in order to cause two or more perforating tunnels to intersect at a prescribed distance outside of the well casing. All known current methods require special tooling that have long and costly lead times and are deficient in actually securing the angle of intercept. Embodiments of tools of the invention help to ensure that the charges collide at the prescribed location outside of the casing. The disclosed apparatus (tool) is comprised of a support strip that is welded or otherwise secured into a tubular support. The spacing between each charge on the support can be adjusted and the flat support base can be inserted at various angles within the support member to accurately control the point of intersection. This flat surface provides a solid base for securing the shaped charge and the round tubing provide the structure needed to form a rigid geometric frame. A flat support strip is described and preferred but concave or convex geometries can also be utilized as the support base to optimize charge performance. This system provides an improvement over other known embodiments by securely and accurately focusing the shaped charges at a variable distance into the formation.

In broad scope the perforating tool of this invention comprises;

a cylindrical barrel having angled circular cutouts for placement of shaped charges in shape, charge cases;

support strips comprising metal strips with a centered hole to receive a shape charge case, wherein the shape charge case has a circumferential projection that will not pass through the hole and provides support for a shaped charge case on the strip;

slots cut into the cylindrical barrel to support the edges of the support strips, cut at a predetermined angle to provide location for perforations from the shaped charges.

Figure 6:
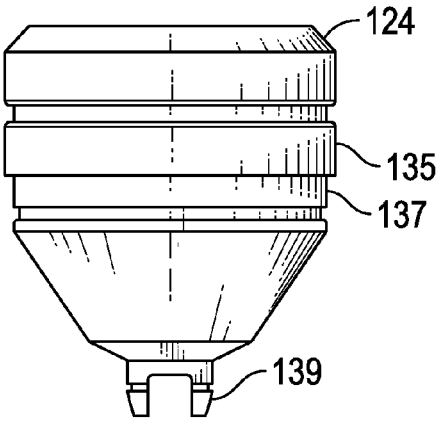
FIG. 6 is a side view of a shaped charge suitable for use in embodiments of the invention.

Referring to FIGS. 1-5 there is illustrated the gun assembly, 100, of an embodiment of the invention. As shown there is the cylindrical gun body, 130, with the barrel (load tube) 126 disposed inside. The barrel, 126, has multiple precision cut slots, 127 that allow the charge case 124 to be inserted, into the barrel 126 and subsequently rest, on the support strip 128. The holes may be located on any side of the circumference of the barrel to achieve the desired target perforations. The holes are preferably cut through the barrel wall at an angle perpendicular (900) to the plane of the orientation of the support strip. A shaped charge case, 124, is disposed in a hole in a support strip (128), resting on a projection, 135, on the circumference of the charge case (see FIGS. 5 and 6). The shape charge case (FIG. 6) has a projection 135 that is larger diameter than the hole in the support strip so that the bottom of this projection (135) rest on the sided of the hole in the support strip. The charge is connected to a detonating cord (or other detonating means) at 139. The charge case is secured to the support strip (128,129) by any suitable means. In a prototype (and possible production model) there is a thin strip cut into the inside barrel wall that may be bent over to press against the top of the charge case projection and thus provide reversible securement means. The charge case may be secured by small clamps, by adhesive or by welding. Other means will be obvious to those skilled in the metal fabrication art. The support strips (128,129) are inserted, into slots cut into the barrel. The support strip will generally be flat metal pieces but may also be curved. Slots in the barrel are angled as desired to allow any configuration of slanted charge paths. If the support strips are metal (preferred) they will be welded into the slots, but they may also be attached by other means such as a strong adhesive, a locking mechanism built into the slots and support strips or any other means that will achieve a secure attachment as will be apparent to those skilled in the art. This arrangement of charge cases securely rested and secured on the support plates, together with the ability to angle the flat plated into the barrel at any desired angle provides the means of relatively simple, precise and reliable angled charge placemat and therefore perforation placement.

Figure 2:
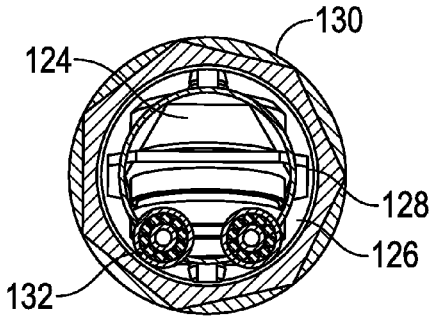
FIG. 2 is an end view of the perforating gun shown in FIG. 1.
Figure 3:
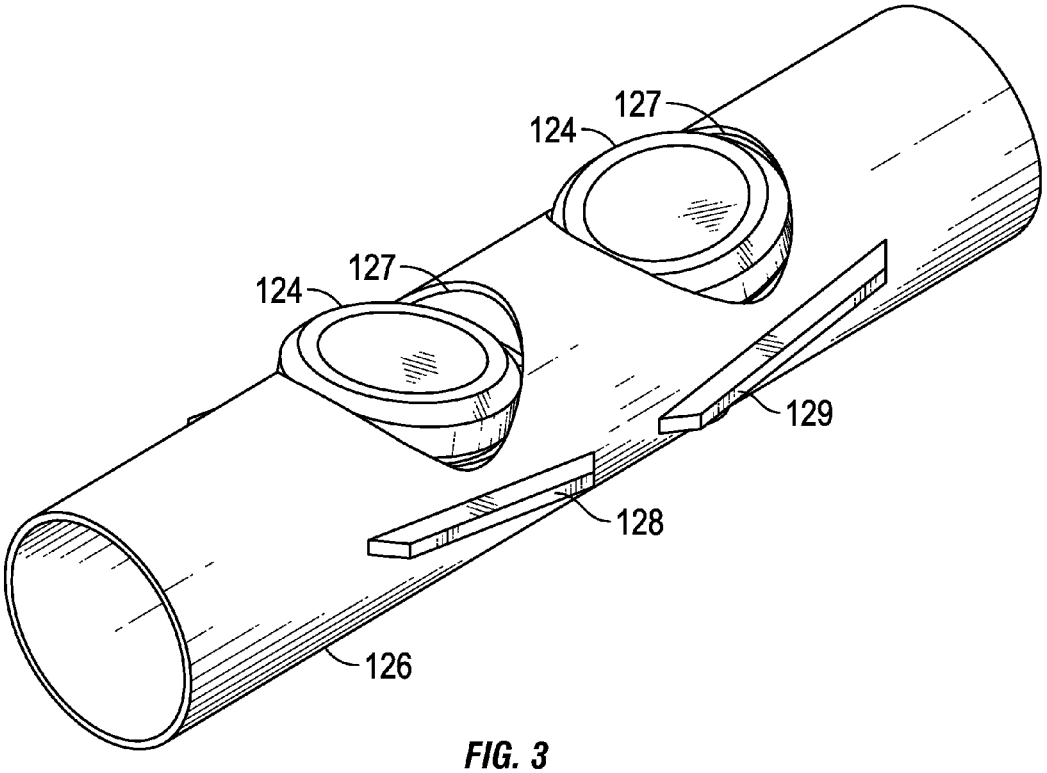
FIG. 3 is a perspective view of the barrel and shaped charges of an embodiment of the invention.
Figure 4:
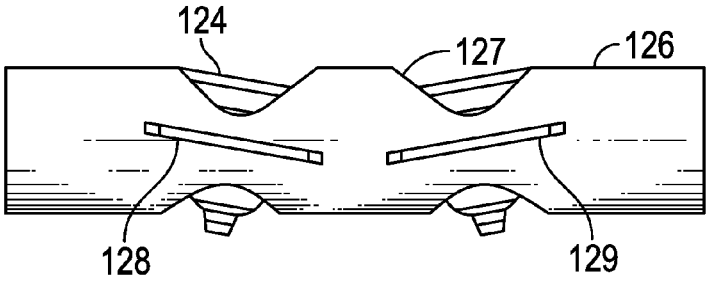
FIG. 4 is aside view of the embodiment of FIG. 3.
Figure 5:
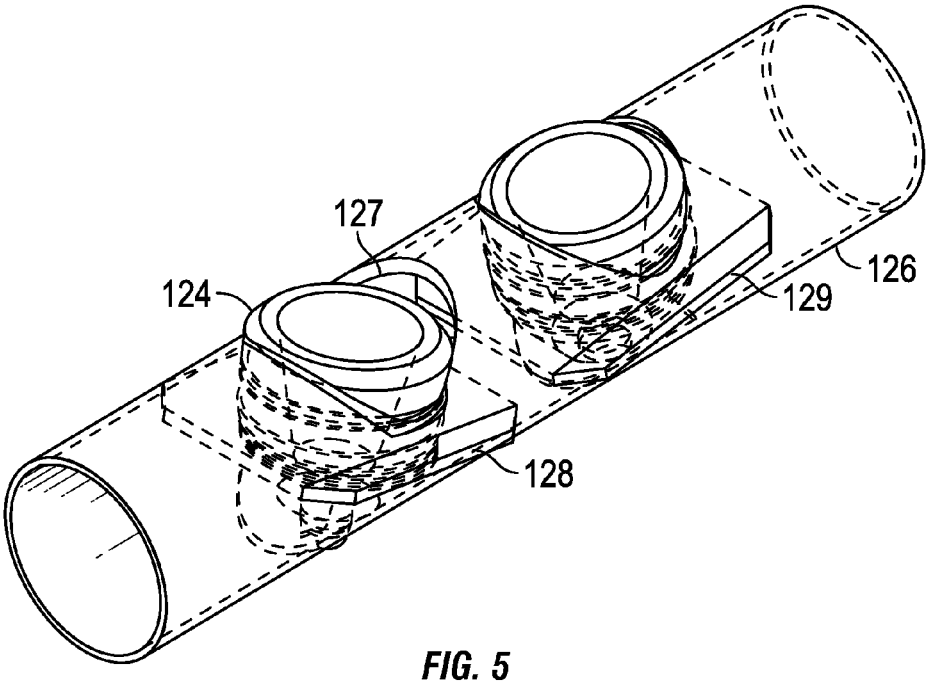
FIG. 5 is a perspective view of a barrel of an embodiment of the invention showing placement of shaped charges on a support strip.

The barrel is secured in gun body at each end as shown in FIGS. 1 and 2 (125 and 132) or by other suitable means within the skill of those skilled in the art. Computer aided laser machining greatly facilitated the precision and reliability of the cuts needed in manufacturing the tools of embodiments of this invention, particularly the barrel cut openings (127) and the slots for the charge plate.

In operation the desired angles are predetermined to achieve the desired perforation intersection pattern and the barrel cuts designed and machined accordingly. The barrel is disposed in a gun body for use in a well bore.

Preferred Exemplary System Block Diagram of a Limited Entry Phasing Perforating Gun System (0700-0800)

Figure 7:
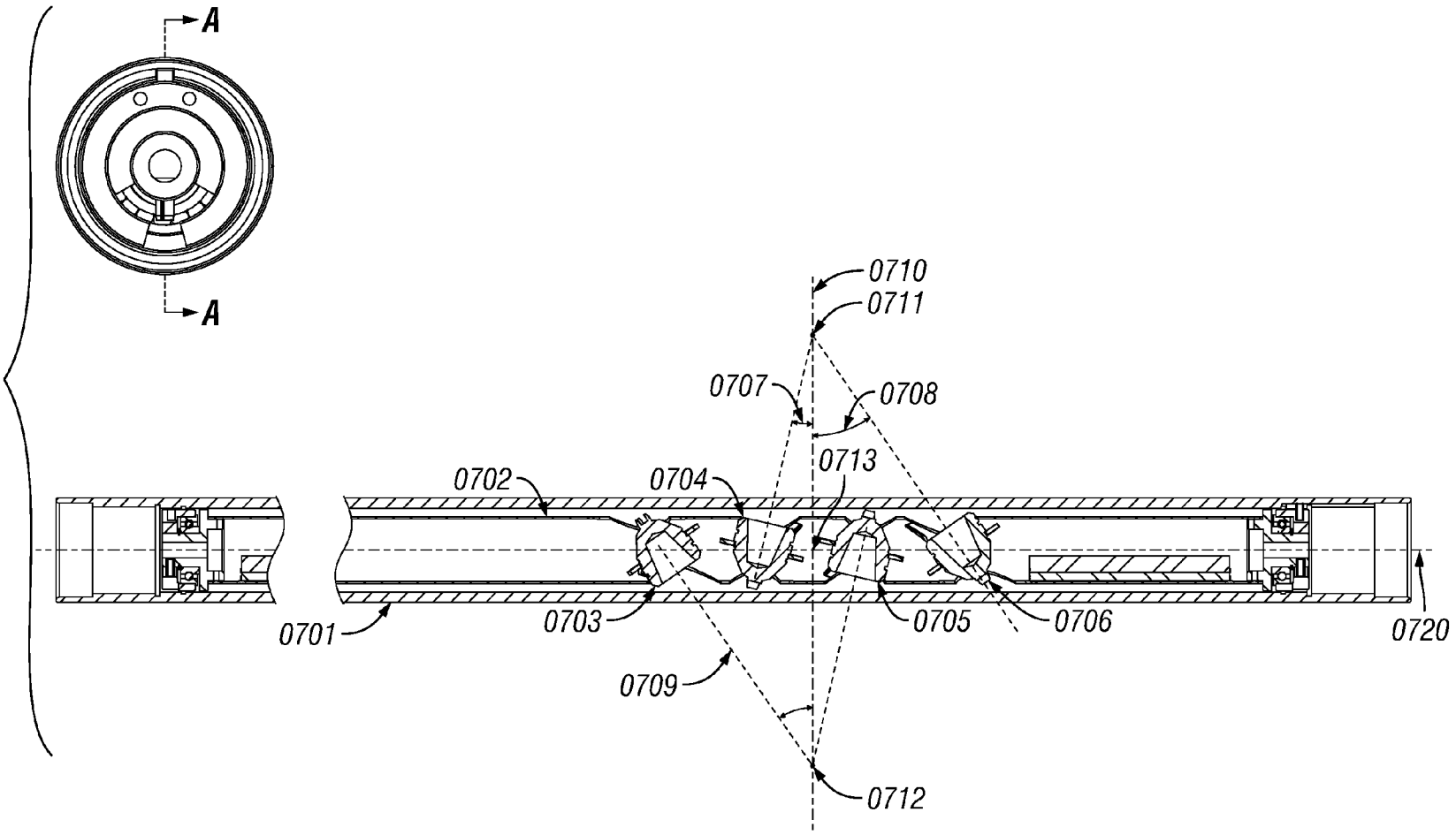
FIG. 7 illustrates an exemplary system cross section of alternatively positioned shaped charges in a perforating gun according to a preferred embodiment of the present invention.
Figure 7A:
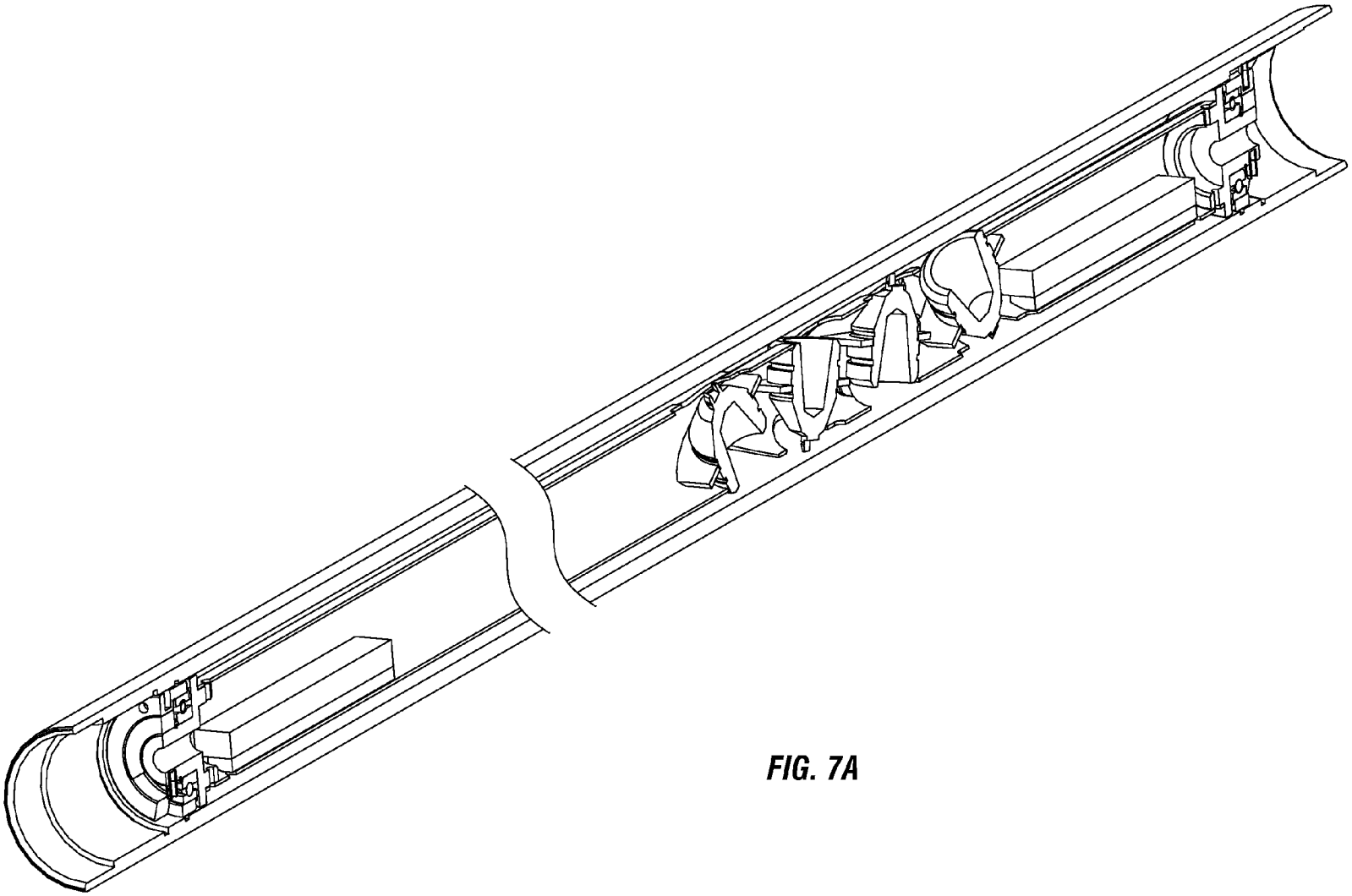
FIG. 7A illustrates an exemplary system perspective view of alternatively positioned shaped charges in a perforating gun according to a preferred embodiment of the present invention.

The present invention may be seen in more detail as generally illustrated in FIG. 7 (0700), wherein a perforating gun is deployed inside a wellbore casing along with plural shaped charges (0707, 0704, 0705, 0706). The plural shaped charges in the gun together may herein be referred to as "cluster". Even though four charges have been shown in the FIG. 7 (0700), the cluster may comprise two angled charges according to a preferred exemplary embodiment.

Limited entry perforation provides an excellent means of diverting fracturing treatments over several zones of interest at a given injection rate. In a given hydrocarbon formation multiple fractures are not efficient as they create tortuous paths for the fracturing fluid and therefore results in a loss of pressure and energy. In a given wellbore, it is more efficient to isolate more zones with clusters comprising less shaped charges as compared to less zones with clusters comprising more shaped charges. For example, at a pressure of 10000 PSI, to achieve 2 barrels per minute flow rate per perforation tunnel, 12 to 20 zones and 12-15 clusters each with 15-20 shaped charges are used currently. Instead, to achieve the same flow rate, a more efficient method and system is isolating 80 zones with more clusters and using 2 or 4 shaped charges per cluster while perforating to intersect at a preferred fracturing plane. Based on the geology of the hydrocarbon, a preferred fracturing plane may be determined. It has been found in field studies that the preferred fracturing plane is perpendicular to the wellbore casing orientation.

As generally illustrated in FIG. 7 (0700), the preferred perforating plane (0710) is transversely perpendicular to the wellbore orientation (0720). According to a preferred exemplary embodiment, the wellbore orientation (0720) may be at slight angle to the horizontal. The slight angle may be within a range of +−30 degrees.

According to yet another preferred exemplary embodiment, increasing the number of fracturing zones with an increasing number of clusters while limiting the shaped charges to 2 or 4 per cluster provides for better efficiency in fracturing a preferred fracturing plane. Conventional perforating systems use 12-15 shaped charges per cluster while perforating in a 60/90/120 degrees or a 0/180 degrees phasing. This creates multiple fractures planes that are not efficient for fracturing treatment as the fracturing fluid follows a tortuous path while leaking energy/pressure intended for each fracture. Creating minimum number of multiple fractures near the wellbore is desired so that energy is primarily focused on the preferred fracturing plane than leaking off or losing energy to undesired fractures. According to a preferred exemplary embodiment, orienting limited number of shaped charges per cluster that intersect at a preferred fracturing plane creates longer extension of fractures as a result of minimal tortuosity and minimal multiple fracture initiations. Ideally, 6 charges may be radially positioned around the gun such, that they perforate in the same plane. But, the configuration requires smaller charges and larger diameter guns. Due to the physical limitations of charge effectiveness and perforating gun diameter, it may be desirable to limit the shaped charges to 2 or 4 per cluster. Such a system would enable fracturing fluid to go down the length of the perforation tunnel and intersect at a place where the fracture is created while connecting to the fracture below to create a least tortuous path. According to a preferred exemplary embodiment, 60 to 80 clusters with 2 or 4 charges per cluster may be used in a wellbore completion to achieve maximum efficiency during oil and gas production.

After a stage has been isolated for perforation, a perforating gun string assembly (GSA) may be deployed and positioned in the isolated stage. The GSA may include a string of perforating guns such as gun (0700) mechanically coupled to each other through tandems or subs or transfers. After a GSA is pumped into the wellbore casing (0701), the GSA may position on the bottom surface of the casing due to gravity. The GSA may orient itself such that the charges (0707, 0704, 0705, 0706) inside a charge holder tube (CHT) are angularly oriented. The charges may be oriented with a metal strip (0702) as aforementioned. According to a preferred exemplary embodiment, an internal pivot support is shaped as a gimbal to suspend the charges so that they are angularly oriented towards the preferred fracturing plane. The spacing between the spaced charges (0707, 0704, 0705, 0706) may be equal or unequal depending on distance required to achieve the desired orientation. In one exemplary preferred embodiment, the charges are spaced equally at 3 inches apart. For example, space charge (0703) and space charge (0704) are positioned at a distance (0709) of 3 inches. The spacing between the space charges may range from 1 inch to 20 inches.

In another preferred exemplary embodiment two space charges (0703, 0705) are angularly oriented downwards ("downward charges") and two space charges (0704, 0706) are angularly oriented upwards ("upward charges"). The angle of the upward charges may be such that they are oriented to intersect at a preferred fracturing plane (0710) at an upward initiation point (0711). In one preferred exemplary embodiment, the upward charge (0704) is oriented at an angle (0707) of 13 degrees to the preferred fracturing plane (0710) and the upward charge (0706) is oriented at an angle (0708) of 35 degrees to the preferred fracturing plane (0710). The angle of the upward charge to the preferred fracturing plane (0710) may range from 1 degree to 75 degrees. Similarly, the angle of the downward charges may be such that they are oriented to intersect at a preferred, fracturing plane (0710) at a downward initiation point (0712). According to yet another preferred exemplary embodiment, the downward charge (0703) is oriented at an angle of 35 degrees to the preferred fracturing plane (0710) and the downward charge (0705) is oriented at an angle of 13 degrees to the preferred fracturing plane (0710). The angle of the downward charge to the preferred fracturing plane (0710) may range from 1 degree to 75 degrees. According to a further exemplary embodiment, the upward initiation point and the downward initiation point are equidistant from a longitudinal axis of said perforating gun (0700). For example, the distance from downward initiation point (0712) to an intersecting point (0713) may be equal to the distance from upward initiation point (0711) to the intersecting point (0713).

Figure 8:
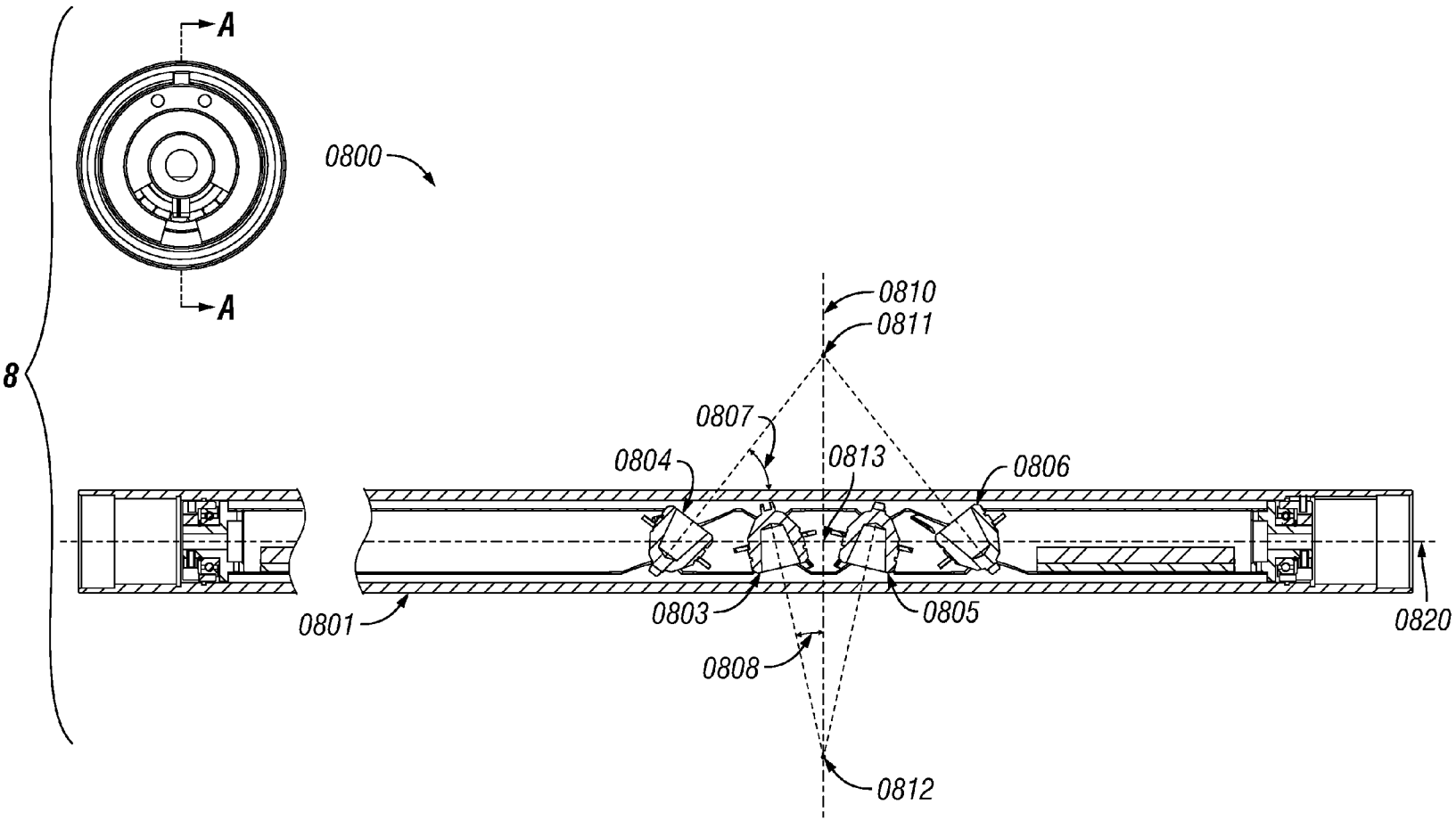
FIG. 8 illustrates an exemplary system cross section of shaped charges in a perforating gun according to a preferred embodiment of the present invention.
Figure 8A:
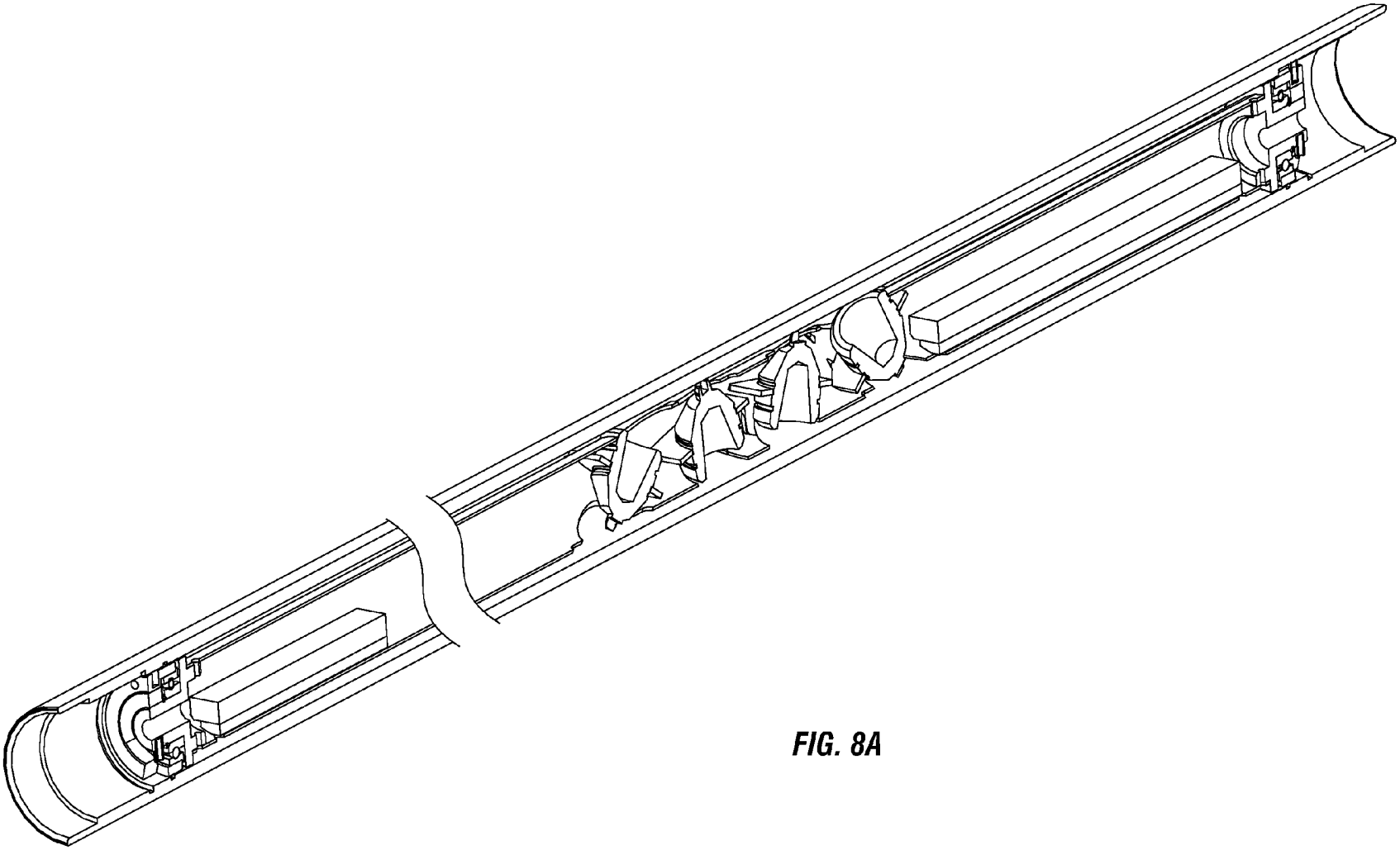
FIG. 8A illustrates an exemplary system perspective view of shaped charges in a perforating gun according to a preferred embodiment of the present invention.

In yet another preferred exemplary embodiment, the two upward charges are positioned at two ends of the cluster and the two downward charges are positioned between the upward charges. The charges are arranged such that at least two of the charges with same orientation are in between at least two of the charges with opposite orientation. For example, as illustrated in FIG. 8 (0800), the upward charges (0804, 0806) are positioned at the two ends of the cluster and the downward charges (0803, 0805) are positioned in between the upward charges. Alternatively, the downward charges (0803, 0805) may be positioned at the two ends of the cluster and the upward charges (0804, 0806) are positioned in between the downward charges. The angle of the upward charges may be such that they are oriented to intersect at a preferred fracturing plane (0810) at an upward initiation point (0811). The angle of the downward charges may be such that they are oriented to intersect at a preferred fracturing plane (0810) at a downward initiation point (0812). In a further preferred exemplary embodiment, the upward charges are oriented at a 52 degree angle to the wellbore orientation (0820). As generally illustrated in FIG. 8 (0800), upward charge (0804) is angled at 52 degrees to the wellbore orientation (0820). Similarly, upward charge (0806) is angled (0807) at 52 degrees to the wellbore orientation (0820). The angle of the upward charge to the wellbore orientation (0810) may range from 1 degree to 75 degrees. In a further preferred exemplary embodiment, the downward charges are oriented at a 13 degree angle (0808) to the wellbore orientation. The angle of the downward charge to the wellbore orientation (0810) may range from 1 degree to 75 degrees. According to a further exemplary embodiment, the upward initiation point and the downward initiation point are equidistant from a longitudinal axis of said perforating gun (0800). For example, the distance from downward initiation point (0812) to an intersecting point (0813) may be equal to the distance from upward initiation point (0811) to the intersecting point (0813). It should be noted that the orientation of the shaped charges are shown for illustration purposes only. One ordinarily skilled in the art would choose an angle such the charges intersect at a preferred fracturing plane.

Preferred Exemplary System Block Diagram of Preferred Fracturing Plane (0900)

Figure 9:
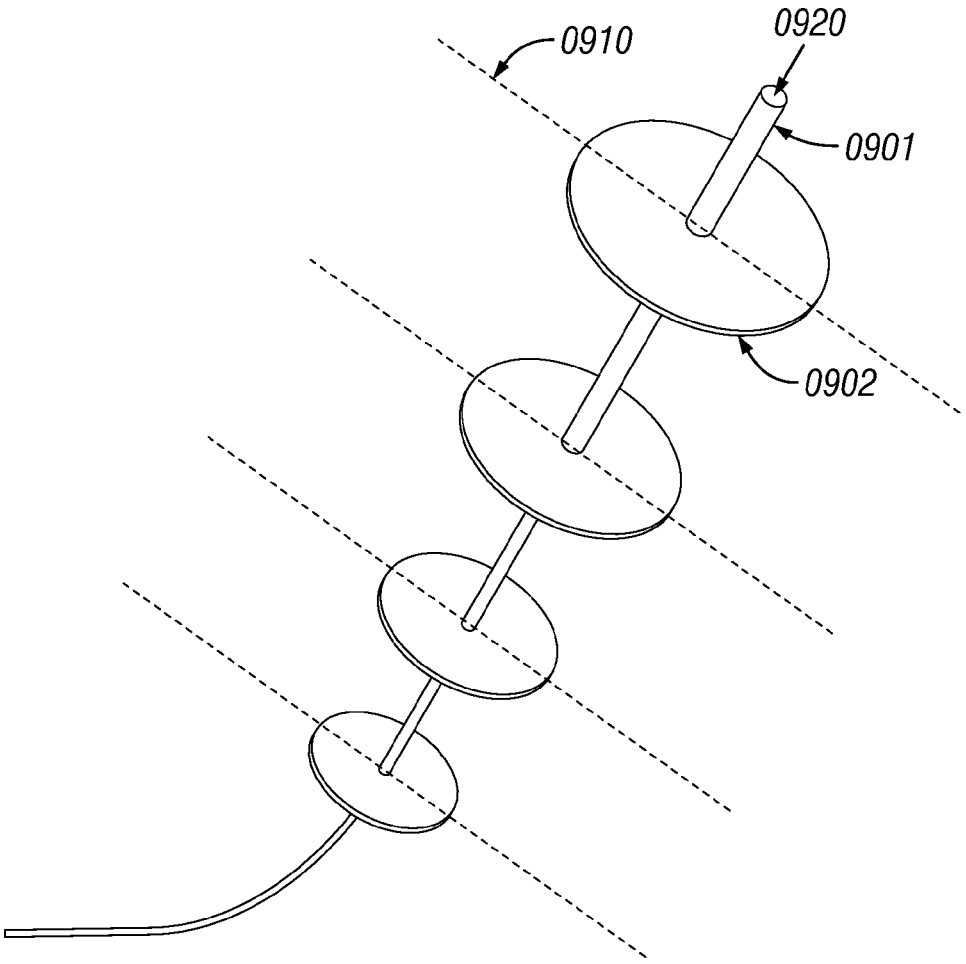
FIG. 9 illustrates an exemplary system block diagram of preferred fracturing plane according to a preferred embodiment of the present invention.

FIG. 9 (0900) shows multiple fracture zones (0902) fractured with oriented shaped charges perforated with angularly oriented charges intersecting at a preferred fracturing plane according to an exemplary embodiment. After a zone is isolated, a gun string assembly (GSA) is lowered into a wellbore casing (0901). The perforating gun system as aforementioned perforates a stage with the oriented charges that intersect at preferred fracturing plane (0910). According to a preferred exemplary embodiment, the preferred fracturing plane (0910) is almost transversely perpendicular to the orientation (0920) of the well bore. The preferred fracturing plane (0910) may be at a slight offset angle to the transversely perpendicular orientation. The slight offset angle may be within a range of +−45 degrees. For example, the fracturing plane (0910) may be at angle of 80 degrees to the well bore orientation. In another example, the fracturing plane (0910) may be at angle of 45 degrees to the well bore orientation. In another example, the fracturing plane (0910) may be at angle of 90 degrees (transversely perpendicular) to the well bore orientation. With a wireline, the GSA is pulled up the wellbore in the zone to the next stage and perforated in a similar manner until all the stages in the fracture zone are perforated. A fracturing fluid is then pumped at high pressures so that the fracture fluid extends the fractures to the maximum extent in the preferred perforating orientation. The extent of the fracture length extending radially outward from the wellbore casing may be 1000 feet according to a preferred exemplary embodiment.

Preferred Exemplary System Block Diagram of Preferred Initiation Point in a Preferred Fracturing Plane Perforating Gun System (1000)

Figure 10:
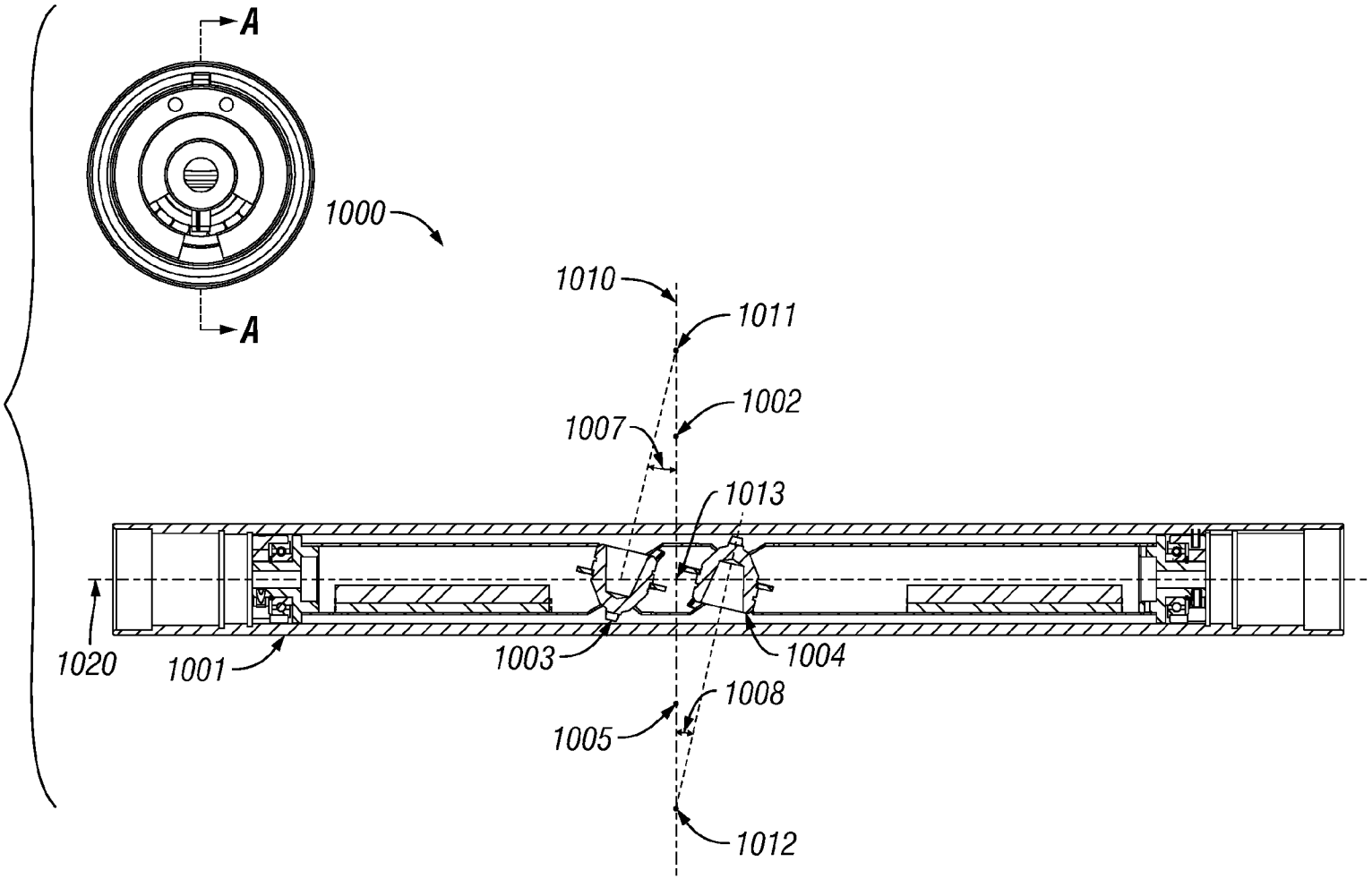
FIG. 10 illustrates an exemplary system cross section of upward and downward shaped charges in a perforating gun for creating preferred initiation points in a preferred fracturing plane according to a preferred embodiment of the present invention.

The present invention may be seen in more detail as generally illustrated in FIG. 10 (1000), wherein a perforating gun is deployed inside a wellbore casing along with plural shaped charges (1003, 1004). The plural shaped charges in the gun together may herein be referred to as "cluster". Even though two charges have been shown in the FIG. 10 (1000), the cluster may comprise four angled charges according to a preferred exemplary embodiment.

As generally illustrated in FIG. 10 (1000), the preferred perforating plane (1010) may be transversely perpendicular to the wellbore orientation (1020). According to a preferred exemplary embodiment, the wellbore orientation (1020) may be at slight angle to the horizontal.

According to a preferred exemplary embodiment, orienting limited number of shaped charges per cluster that intersect at a preferred fracturing plane creates longer extension of fractures as a result of minimal tortuosity and minimal multiple fracture initiations. The orientation of the shaped charges may be such that when perforating, the upward charge (1003) creates a preferred upward fracture initiation point (1011) in the fracture tunnels and downward charge (1004) creates a preferred downward fracture initiation point (1012) in fracture tunnels. According to a preferred exemplary embodiment, the preferred upward fracture initiation point (1011) and preferred downward fracture initiation point (1012) may lie in same preferred fracture plane. Similarly, preferred upward fracture initiation point (1002) and preferred downward fracture initiation point (1005) may be created by the charges to create desired fracture initiation length for efficient fracture and minimal tortuosity conditions. The length of the preferred fracture initiation may be customized by orienting the charges at a desired angle. For example, upward charge (1003) could be angled (1007) to initiate a preferred fracture initiation point (1011) in the preferred fracture plane (1010). Similarly, downward charge (1004) could be angled (1008) to initiate a preferred fracture initiation point (1012) in the preferred fracture plane (1010). According to an exemplary embodiment, preferred fracture initiation points may be created at select distances in the preferred fracture plane in order to efficiently fracture the tunnels with minimum tortuosity. The upward charge and the downward charge may be oriented, within 1 degree to 75 degrees to the preferred fracturing plane (1010). According to an exemplary embodiment, the distance from, the preferred upward fracture initiation point (1011) to the intersecting longitudinal axis point (1013) may be equal to the distance from the preferred downward fracture initiation point (1012) to the intersecting longitudinal axis point (1013). The upward initiation point and the downward initiation point are equidistant from a longitudinal axis of the perforating gun. In another preferred exemplary, the upward initiation point and the downward initiation point are equidistant from a centerline of the well bore casing. In some instances the centerline of the well bore casing and the longitudinal axis of the perforating gun may the same. In other instances, the centerline of the well bore casing may be higher than the longitudinal axis of the perforating gun.

Preferred Exemplary Flowchart Embodiment of an Phasing Wellbore Perforation (1100)

Figure 11:
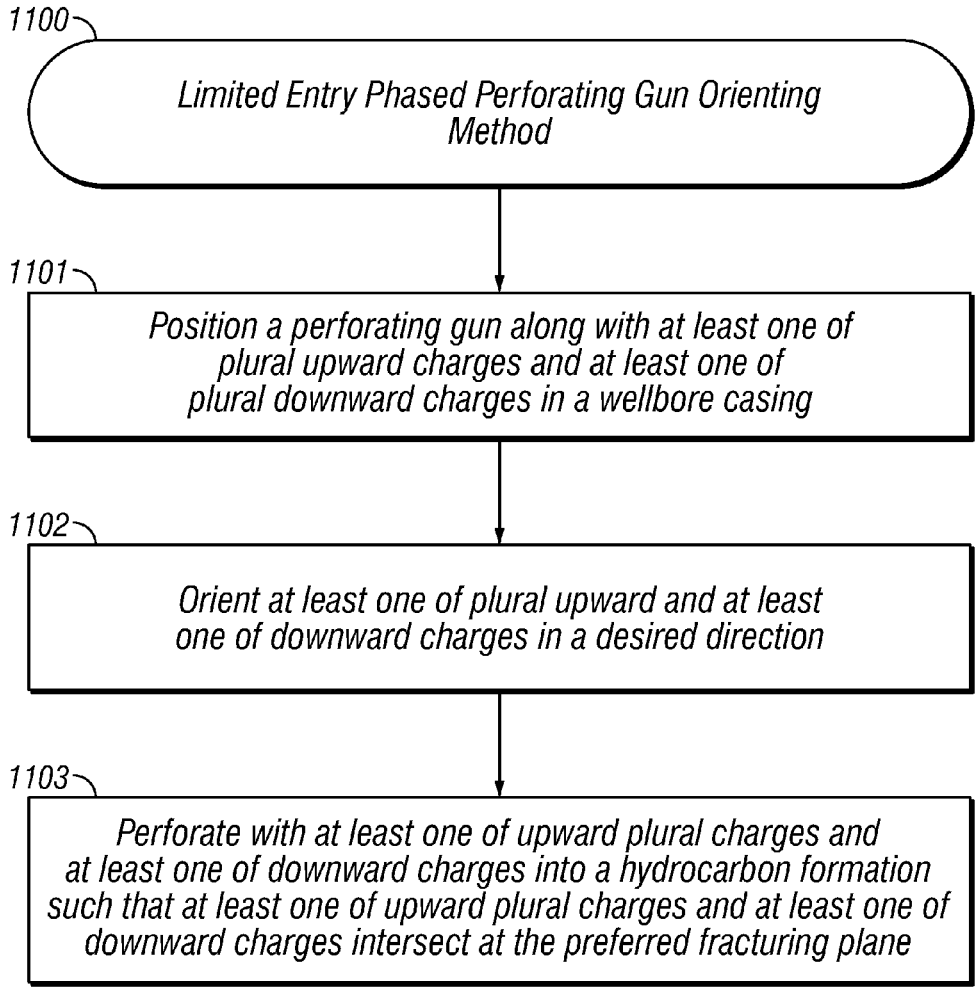
FIG. 11 illustrates a detailed flowchart of a preferred exemplary phasing perforation method with shaped charges according to preferred exemplary invention embodiments.

As generally seen in the flow chart of FIG. 11 (1100), a preferred exemplary phasing wellbore perforation method with angularly oriented shaped charges may be generally described in terms of the following steps:

(1) positioning the gun along with at least one of the plural upward charges and at least one of plural downward charges in the wellbore casing (1101);

(2) orienting at least one of the plural upward charges and at least one of plural downward charges in a desired direction (1102); and (3) perforating with at least one of the plural upward charges and at least one of plural downward charges into a hydrocarbon formation such that at least one of the plural upward charges and at least one of plural downward charges intersect at the preferred fracturing plane (1103).

System Summary

The present invention system, anticipates a wide variety of variations in the basic theme of phasing perforating gun orienting system in a wellbore casing comprising a plurality of upwardly oriented shaped charges (upward charges) and a plurality of downwardly oriented shaped charges (downward charges) wherein:

at least one of the upward charge is configured to orient in an angularly upward direction to orientation of the wellbore casing;

at least one of the downward charge is configured to orient in a angularly downward direction to orientation of the wellbore casing; and when perforating, the plural upward charges and the plural downward charges are configured, to intersect in a preferred fracturing plane; the preferred fracturing plane is transversely perpendicular to orientation of the wellbore casing.

This general system summary may be augmented, by the various elements described herein to produce a wide variety of invention embodiments consistent with this overall design description.

Method Summary

The present invention method anticipates a wide variety of variations in the basic theme of implementation, but can be generalized as a limited entry phasing perforating gun method wherein the method is performed on a phasing perforating gun system comprising a plurality of upwardly oriented shaped charges (upward charges) and a plurality of downwardly oriented shaped charges (downward charges) wherein:

at least of one the upward charge is configured to orient in an angularly upward direction to orientation of the wellbore casing;

at least of one the downward charge is configured, to orient in a angularly downward direction to orientation of the wellbore casing; and when perforating, the plural upward charges and the plural downward charges are configured, to intersect in a preferred fracturing plane; the preferred fracturing plane is transversely perpendicular to orientation of the wellbore casing;

wherein the method comprises the steps of:

(1) positioning the gun along with at least one of the plural upward charges and at least one of plural downward charges in the wellbore casing;

(2) orienting at least one of plural upward charges and at least one of plural downward charges in a desired direction; and (3) perforating with at least one of the plural upward charges and at least one of plural downward charges into a hydrocarbon formation such that at least one of the plural upward charges and at least one of plural downward charges intersect at the preferred fracturing plane.

This general method summary may be augmented, by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited, to:

An embodiment wherein the plural upward charges are spaced equally.

An embodiment wherein the plural downward, charges are spaced equally.

An embodiment wherein the perforating gun comprises one the upward charges and one the downward charges.

An embodiment wherein the perforating gun comprises two the upward charges and two the downward charges.

An embodiment wherein the upward charges are configured to intersect at an upward initiation point in the preferred fracturing plane; the downward charges are configured to intersect at a downward initiation point in the preferred fracturing plane; and the upward initiation point and the downward initiation point are equidistant from a longitudinal axis of the perforating gun.

An embodiment wherein the plural downward charges are positioned in between the plural upward charges.

An embodiment wherein an angle between at least one the upward charge orientation and the wellbore casing orientation is between 1 degrees and 75 degrees.

An embodiment wherein an angle between at least one the downward charge orientation and the wellbore casing orientation is between 1 degrees and 75 degrees.

An embodiment wherein an angle between at least one the upward charge orientation and the wellbore casing orientation is 52 degrees.

An embodiment wherein an angle between at least one the downward charge orientation and the wellbore casing orientation is 13 degrees.

An embodiment wherein the plural upward charges and the plural downward charges are positioned alternatively in the perforating gun.

An embodiment wherein an angle between at least one the upward charge and the preferred fracturing plane is in between 1 degrees and 75 degrees.

An embodiment wherein an angle between at least one the downward charge and said preferred fracturing plane is in between 1 degrees and 75 degrees. An embodiment wherein:

an angle between at least one the upward charge and the preferred fracturing plane is 13 degrees;

angle between at least one the upward charge and the preferred fracturing plane is 35 degrees;

angle between at least one the downward charge and the preferred fracturing plane is 13 degrees; and angle between at least one the downward charge and the preferred fracturing plane is 35 degrees.

An embodiment wherein the wellbore casing orientation is horizontal.

An embodiment wherein the wellbore casing orientation is at an angle to horizontal direction.

An embodiment, wherein the shaped, charged, are oriented, with a swivel; the swivel is internally attached to said gun.

One skilled in the art will recognize that other embodiments are possible based on combinations of elements taught within the above invention description.

CONCLUSION

A limited entry perforating phasing gun system and method for accurate perforation in a deviated/horizontal wellbore has been disclosed. The system/method includes a gun string assembly (GSA) deployed in a wellbore with shaped charge clusters. The charges are spaced and angled such that, when, perforated, they intersect at a preferred fracturing plane. Upon fracturing, the fractures initiate at least principal stress location in a preferred fracturing plane perpendicular to the wellbore from an upward and downward, location of the wellbore. Thereafter, the fractures connect radially about the wellbore in the preferred fracturing plane. The fracture treatment in the preferred, fracturing plane creates minimal tortuosity paths for longer extension of fractures that enables efficient oil and gas flow rates during production.

What is claimed is:

1. A phased perforating gun orienting system in a horizontal wellbore casing comprising a plurality of upwardly oriented shaped charges (upward charges) and a plurality of downwardly oriented shaped charges (downward charges); each of said upward charges and said downward charges are spaced apart along a horizontal axis and each of said upward charges and said downward charges are configured to occupy a distinct transverse plane along said horizontal axis; wherein:

at least one said upward charge is configured to orient in an angularly upward direction such that when perforating at least one said upward charge creates a preferred upward fracture initiation point in a hydrocarbon formation above said horizontal axis along said wellbore casing;

at least one said downward charge is configured to orient in a angularly downward direction; such that when perforating at least one said downward charge creates a preferred downward fracture initiation point in a hydrocarbon formation below said horizontal axis along said wellbore casing; and said preferred upward fracture initiation point, said preferred downward fracture initiation point and a point along said horizontal axis along said wellbore casing lie in a preferred fracture plane; said preferred fracture plane is transverse to said horizontal axis.

2. The phased perforating gun orientation system of claim 1 wherein an angle between at least one said upward charge and said preferred fracturing plane is in between 1 degree and 75 degrees.

3. The phased perforating gun orientation system of claim 1 wherein an angle between at least one said downward charge and said preferred fracturing plane is in between 1 degree and 75 degrees.

4. The phased perforating gun orientation system of claim 1 said preferred upward fracture initiation point and said preferred downward fracture initiation point are equidistant from a longitudinal axis of said perforating gun.

5. The phased perforating gun orientation system of claim 1 said preferred upward fracture initiation point and said preferred downward fracture initiation point are equidistant from a centerline of said well bore casing.

6. The phased perforating gun orientation system of claim 1 wherein said perforating gun comprises one said upward charges and one said downward charges.

7. The phased perforating gun orientation system of claim 1 wherein said perforating gun comprises two said upward charges and two said downward charges.

* * * * *